US012372274B1

(12) United States Patent
Davis et al.

(10) Patent No.: US 12,372,274 B1
(45) Date of Patent: Jul. 29, 2025

(54) HELIUM PHASE SEPARATION REFRIGERATOR

(71) Applicant: Zero Point Cryogenics Incorporated, Edmonton (CA)

(72) Inventors: John Davis, Edmonton (CA); Paul Kim, Edmonton (CA); Marvin Hirschel, Opal (CA); James Suranyi, Sturgeon County (CC)

(73) Assignee: Zero Point Cryogenics Incorporated, Edmonton (CA)

( * ) Notice: Subject to any disclaimer, the term of this patent is extended or adjusted under 35 U.S.C. 154(b) by 0 days.

(21) Appl. No.: 18/980,522

(22) Filed: Dec. 13, 2024

(30) Foreign Application Priority Data

Dec. 12, 2024 (CA) ..... CA 3259443

(51) Int. Cl.
*F25B 9/12* (2006.01)
*F25B 9/14* (2006.01)

(52) U.S. Cl.
CPC . *F25B 9/12* (2013.01); *F25B 9/14* (2013.01)

(58) Field of Classification Search
CPC ..... F25B 9/12
See application file for complete search history.

(56) References Cited

U.S. PATENT DOCUMENTS 5,189,880 A * 3/1993 Frossati ..... F25B 9/12 62/610
6,202,439 B1 * 3/2001 Mikheev ..... F25B 9/12 62/51.1
2018/0112928 A1 * 4/2018 Dorr ..... F28F 21/02

OTHER PUBLICATIONS

Burton, J.C. et al. "A continuous $^3$He cryostat with pulse-tube pre-cooling and optical access", Cryogenics 51, 2011, pp. 209-213, 5 pgs.
Zhao et al. "Chapter 9 Cryogen-Free 3He Systems", Cryogenic Engineering and Technologies, 2020, pp. 257-289, 33 pgs.
The Wayback Machine, "a DRY ICE 300mK Continuous He-3 Cryostat", (archive.org).pdf publication date (on archive.org) Apr. 17, 2021, download date Jan. 7, 2025, https://web.archive.org/web/20210417203042/https://www.iceoxford.com/a-DRY-ICE-300mK-Continuous-He-3-Cryostat.htm, 5 pgs.
Iceoxford, "DRY ICE 300mK Series, 280mK to 425K", Brochure reduced (archive.org).pdf, publication date (on archive.org) Sep. 27, 2023, download date Jan. 7, 2025, https://web.archive.org/web/20230927121431/https://www.iceoxford.com/files/image/files/DRY%20ICE%20300mK%20Series%20Brochure%20reduced.pdf, 2 pgs.
Bluefors, "LDHe Measurement System", 240—Bluefors, publication date unknown, download date Jan. 7, 2025, https://bluefors.com/products/1k-systems/ldhe-measurement-system/, 15 pgs.

(Continued)

*Primary Examiner* — Brian M King
(74) *Attorney, Agent, or Firm* — Seed IP Law Group LLP

(57) ABSTRACT

A cryogenic refrigerator uses a mixture of helium-3 and helium-4. Gaseous helium is pumped from a reservoir containing a liquid mixture of helium-3 and helium-4 to cause cooling and a phase separation into an upper helium-3 rich phase which floats at the top for further evaporation and a lower dilute phase below the helium-3 rich phase. This separation enables operation at temperatures typical of a helium-3 refrigerator while initial liquefaction of the mixture is easier than liquefaction of pure helium-3 and can use a smaller amount of helium-3. Embodiments of the refrigerator can provide continuous cooling.

23 Claims, 3 Drawing Sheets

(56) References Cited

OTHER PUBLICATIONS

The Wayback Machine, "LDHE Measurement System" 240—Bluefors (archive.org) .pdf, publication date (on archive.org) Dec. 5, 2023, download date Jan. 7, 2025, https://web.archive.org/web/20231205121823/https://bluefors.com/products/1k-systems/ldhe-measurement-system/, 13 pgs.

* cited by examiner

HELIUM PHASE SEPARATION REFRIGERATOR

TECHNICAL FIELD

The present disclosure pertains to cryogenic refrigeration, particularly using helium-3.

BACKGROUND

Many aspects of the physical sciences must be studied at low temperatures at or below 4 K including the study of quantum materials and quantum circuits. For example, the quantum bits, or qubits, that make up modern quantum computers must be operated in a regime at or near the ground state occupation of their respective quantum harmonic oscillator, and in the case of superconducting qubits must be operated in a regime without circuit resistance—hence taking advantage of superconductivity—itself a quantum phenomenon. Beyond superconducting qubits, many other quantum computing architectures require low temperatures, reducing loss to phonons in color centers or even taking advantage of superconductivity in transition edge sensors for photonic computing.

Methods for achieving low temperatures at or below 4 K are of great importance to both science and technology. One method for achieving low temperatures above 4 K is to take advantage of a liquid cryogen, such as liquid nitrogen at 77 K or liquid helium-4 at 4.2 K, at standard pressure. To cool below this, one must harness the tools of thermodynamics, such as pumping on these liquid cryogens to achieve evaporative cooling. By pumping on liquid helium-4, one can cool below 1 K. In a traditional "wet" refrigerator, that is using liquid helium-4 as a cryogenic bath, the liquid helium is let into a "pot"—a small volume separated from the main bath by some impedance, whether fixed or variable—which could then be pumped on by an external pump. The helium pumped out of the pot is typically vented to the room, although it could certainly be recovered and re-condensed by a separate cryogenic system. In this way, one can provide continuous cooling below 1 K, although this is typically limited to approximately 800 to 900 mK by the exponentially vanishing vapor pressure of liquid helium-4 at these temperatures, see FIG. 2. Cooling in this way is only continuous as long as the bath of liquid helium is periodically refilled. To achieve temperatures below that achievable by a pumped pot of helium-4, one can use the rare isotope, helium-3. That is helium, still with two protons in its atomic nucleus, but now only one neutron. This isotope is exceedingly rare in naturally occurring helium (in the range of 1 ppm depending on its origin), but can be—and is—made in nuclear reactions. Helium-3, being lighter than the common isotope, does not liquefy until 3.2 K at standard pressure and has a higher vapor pressure when compared to helium-4 at an identical temperature. Therefore, helium-3 can be used for evaporative cooling to lower temperatures, practically limited to approximately 300 mK.

Because of the scarcity and expensiveness of helium-3, it is undesirable to vent the pumped helium-3 to the atmosphere. So the design of helium-3 refrigerators, taking advantage of pumped helium-3, are typically operated in a closed-cycle and one-shot method. The most typical method for this is to have an initial pumped helium-4 pot that serves to condense a small volume of helium-3, which is kept in a sealed volume at low temperature. The helium-3 system is composed of three main features: at the bottom is a small pot to hold the liquefied helium-3. The second feature, generally at the top, is an activated charcoal "sorb" that can be varied in temperature, between approximately 4 and 40 K, or higher. The third feature is a thermal connection to an intermediate stage that is below 3.2 K, typically thermally connected to the helium-4 pot operating at approximately 1.5 K. These three elements are all connected, usually by thin stainless steel tubing, allowing for a thermal disconnection between the three, but fully containing the helium-3. The chemical sorb holds a volume of charcoal but also helium-3 and is thermally connected to a heater that can be externally controlled. When the sorb is heated to higher temperatures, the helium-3 is pushed from the sorb towards the lower temperature stages, liquefied at the helium-4 pot, and collected as liquid in the helium-3 pot. When a sufficient amount of helium-3 is condensed into the helium-3 pot, the sorb can be allowed to cool. As the sorb reaches 4-10 K it will begin to pump the helium-3 out of the pot. Due to the large surface area of the charcoal sorb, it can fully pump and collect all of the helium-3 in the system. Thus, the sorb acts as a self-contained pump of the helium-3 pot. However, this is by its very nature a "one-shot" system. When the liquid helium-3 has been pumped from the pot and no more liquid remains, it will no longer have any cooling power and will begin to warm. At this point the sorb must be heated again, starting the condensation cycle again. Once the condensation cycle is complete, the evaporative cooling cycle can begin again. This can cause a low-duty cycle, interrupting tests being performed on the cryogenic system. In all known examples of helium-3 systems, the helium-3 and helium-4 pumping lines (or pumping "circuit") are kept separate, such that the two isotopes do not mix, so the helium-3 is not vented with the helium-4.

Currently, to achieve temperatures below that possible using pumped helium-4 or pumped helium-3, one must use either a non-helium based technique called adiabatic demagnetization, which cools using the temperature dependent entropy of a paramagnetic system in a magnetic field, or by mixing the two isotopes of helium to make a dilution refrigerator. Adiabatic demagnetization is inherently one-shot, and can result in unwanted stray and/or changing magnetic fields. Dilution refrigerators can provide continuous cooling down to as low as 2 mK. Dilution refrigerators take advantage of the phase separation that naturally occurs between the two isotopes of helium below 872 mK at a concentration of 67.3% helium-3 in helium-4, as shown in FIG. 3. Once phase separated, the helium-3 can be pumped from a dilute concentration side, which results in an osmotic pressure that drives helium-3 across the phase boundary from the pure to the dilute side. This process of dilution is what gives this system its name and its continued cooling power even to extremely low temperatures.

With the advent of "cryogen-free" technology, namely Gifford-McMahon (GM) coolers and pulse tube (PT) coolers, new "dry" (that is, without a bath of liquid cryogens such as liquid helium-4) incarnations of these three cryogenic systems (the helium-4 refrigerator, the helium-3 refrigerator, and the dilution refrigerator) have been developed. Generally, instead of a pumped helium-4 pot, these systems will take advantage of a Joule-Thomson (JT) expansion process for cooling, which was absent from the wet versions. In the simplest system, the continuous "1 K" or "1.5 K" system, helium-4 will be enclosed in a pumping circuit. The helium-4 can be condensed by the PT cooler, operating below 4.2 K, generally at an elevated pressure brought about either by the output port of a mechanical pump or sometimes with an additional compressor after the pump output. The helium expands through an impedance or "Joule-Thomson plug", resulting in cooling because the temperature is below the inversion temperature of helium. The opposite side of the impedance is kept at a low pressure by a mechanical pump. In this way, the process can be made to be continuous. That is, the same helium that is pumped out of one side of the impedance can be re-condensed by the GM or PT cooler and once again expanded. After a few cycles of this recirculation process, the cold side of the impedance can collect liquid helium-4. As a result, the cooling power is then exactly as in the wet helium-4 system, determined by the vapor pressure of the helium-4. If sufficient heat is applied to the system to evaporate all of the liquid, they continue to operate, although with significantly less cooling power, relying only on the JT expansion. The base temperature of continuous helium-4 systems is determined primarily by the vapor pressure above the liquid helium, determined by the pumps used and the impedance of the pumping line, while also affected by the pressure of the returning helium and the value of the JT impedance.

While continuous, dry, helium-4 systems have become quite prevalent, as have continuous, dry dilution refrigerators (which operate mainly as a normal wet dilution refrigerator with a JT impedance for liquefying the incoming helium-3/helium-4 mixture), continuous, dry, helium-3 systems are quite rare because of the added complexity of currently realized incarnations of these systems.

We find three examples of such systems. One is a paper by J. C. Burton, E. Van Cleve, and P. Taborek in 2011, describing a continuous, dry, helium-3 refrigerator that condenses the helium-3 into a pot using a separate continuous helium-4 system. Two gas handling systems and associated pumping systems must be used, one for the helium-4 and one for the helium-3, although we note in this example that the authors used a very simple gas handling system for the helium-4 circuit that vented the helium-4 to the atmosphere. The base temperature of their system was 0.36 K, with a cooling power of 1.75 mW at 0.5 K. An inner vacuum can is used to perform pre-cooling of the system through use of helium exchange gas. While this is acceptable for advanced users, the majority of cryogenic users do not like the trouble of the hermetic seals, and corresponding chances of leaks, associated with inner vacuum cans. The second example is in chapter 9 of a book, "Cryogenic Engineering and Technologies", by Zhao and Wang. In this chapter, Zhao discusses the concept of a dry, continuous helium-3 refrigerator as well as a model that uses separate gas handling circuits for the helium-3 and helium-4. A system similar to that described in the book chapter by Zhao has been commercialized by ICEoxford LTD and is available for purchase.

There is a need for a continuous helium refrigerator that is easier and cheaper to operate. The new system described below takes advantage of the phase separation that occurs between the two stable isotopes of helium, but is not a dilution refrigerator in that its cooling power does not come from this process of dilution.

SUMMARY

A cryogenic refrigerator that includes one or more cooling elements arranged to at least partially liquefy helium from a gas containing a mixture of helium-3 and helium-4 to produce liquid helium having a sufficient concentration of helium-3 to enable the separation of the helium-3 and helium-4 when further cooled into separate helium-3 rich and dilute phases. A reservoir is arranged to receive an incoming flow of helium including the liquid helium produced by the one or more cooling elements to form a volume of the liquid helium in the reservoir, and to expose a surface of the volume of the liquid helium to evaporation to cool the reservoir. One or more pumps are connected to the reservoir to remove gaseous helium from a space above the surface to form an outgoing flow of helium from the reservoir to the one or more pumps, the one or more pumps being arranged to sufficiently lower a pressure above the surface of the liquid helium to cool the liquid helium to cause the liquid helium in the reservoir to separate into helium-3 rich and dilute phases. The liquid helium-3 rich phase is adjacent to the pumped surface so that it may further evaporate for further cooling as the pumps in operation continue to remove evaporated helium-3 above the surface after phase separation.

In various embodiments, there may be included any one or more of the following features: There may be a heat exchanger arranged to exchange heat between the incoming flow of helium and the outgoing flow of helium. The one or more cooling elements may comprise a first cooling element and a second cooling element arranged to receive helium from the first cooling element. Where there is a heat exchanger and the first and second cooling elements, the heat exchanger may be arranged to at least in part exchange heat between the outgoing flow of helium and a portion of the incoming flow of helium going from the first cooling element to the second cooling element. The one or more cooling elements may be configured to provide sufficient cooling, in a startup mode without significant cooling via the heat exchanger, to liquefy at least some helium-4, but not configured to provide sufficient cooling in the startup mode to enable the phase separation into separate helium-3 rich and dilute phases, where additional cooling provided by the outgoing flow of helium to the incoming flow of helium then provides sufficient cooling to enable the formation of the separate helium-3 rich and dilute phases. The second cooling element may be a flow restriction causing Joule-Thomson expansion. The flow restriction may have an impedance, for example in the range of $10^9$ to $10^{13}$ $cm^{-3}$, in the range of $10^{10}$ to $10^{12}$ $cm^{-3}$, or of the order of magnitude of $10^{11}$ $cm^{-3}$. The one or more cooling elements may include, for example as the first cooling element where there is a first cooling element and a second cooling element, a pulse tube cooler or a Gifford-McMahon cooler, or a vessel of liquid helium. The first cooling element may at least partially liquefy the incoming flow of helium. The one or more cooling elements may fully liquefy the incoming flow of helium. The one or more cooling elements may be connected to receive the gas from an outlet of the one or more pumps for continuous operation of the cryogenic refrigerator.

These and other aspects of the device and method are set out in the claims.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

At Zero Point Cryogenics we have discovered a method for developing a dry, continuous, helium-3 refrigerator that is much simpler to use than the above three examples in the background, and additionally can operate with significantly smaller amounts of helium-3, critically important as this isotope is scarce and expensive (although we note that none of the three above references clearly state the amount of helium-3 used in their systems). The working principle relies on the phase separation of helium-3 and helium-4, as discussed above in the context of the dilution refrigerator.

Figure 1:
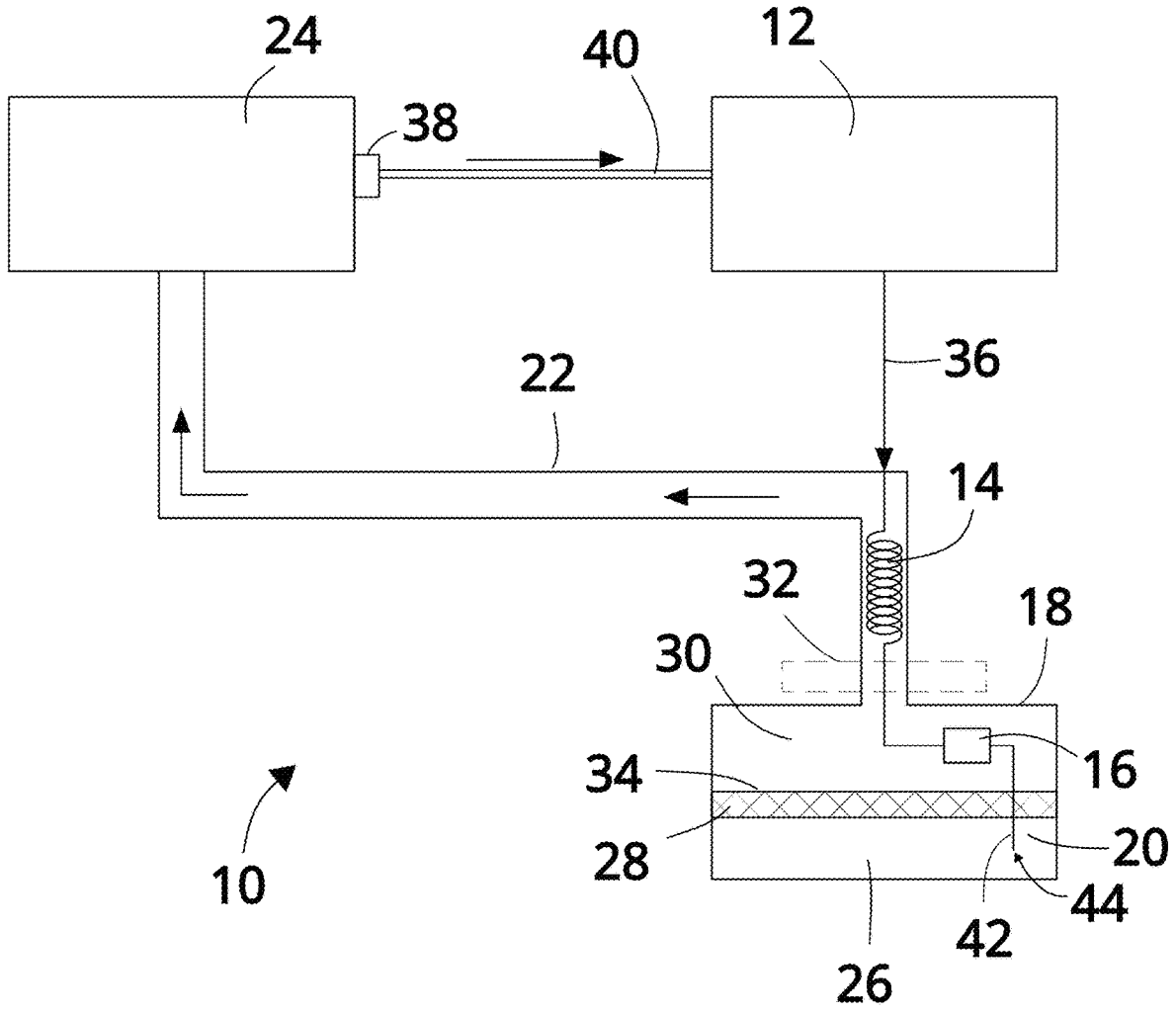
FIG. 1 is a schematic diagram showing an exemplary embodiment of a cryogenic refrigerator.

First, our system, an embodiment 10 of which is shown in FIG. 1, combines the helium-3 and helium-4 pumping circuits into a single pumping system, by mixing helium-3 into helium-4. The gas containing the mixture of helium-3 and helium-4 is then at least partially liquefied using one or more cooling elements to generate liquid helium. The concentration of helium-3 within the liquid helium must be enough, at least at some stage in the cooling process, to enable helium-3 to separate into helium-3 rich and dilute phases. In an embodiment where the cooling elements substantially fully liquefy a unidirectional flow of the mixture of helium-3 and helium-4, the liquid helium may initially have a concentration equal to that of the mixed gas. The concentration of the liquid may however vary over time as evaporation occurs as described below. For example, an initially non-separated helium mixture may disproportionately evolve helium-3 in evaporation and thus cool to cause phase separation. In an example, a concentration of approximately 25% helium-3 is used in the initial mixed helium gas (although concentrations as low as 10% are possible in theory). There is no upper limit to the concentration of helium-3 that could be used from the perspective of obtaining cooling. The overall concentration in the liquid phase(s) in use may differ from the concentration in the initial gas.

In the embodiment of a cryogenic refrigerator 10 shown in FIG. 1, the one or more cooling elements include a first cooling element 12 and a second cooling element 16 arranged to receive helium from the first cooling element 12. In an example, the helium is precooled below 4.2 K, preferably below 3 K, by the first cooling element. In an example, the first cooling element is a pulse tube cooler. Other coolers such as a Gifford-McMahon cooler may also be used. A source of liquid helium, for example a vessel of liquid helium could also be used as the first cooling element. For example, mixed liquid helium-3/helium-4 may be precooled by a heat exchanger with liquid helium-4, which may for example have its own pump or sorb to lower its temperature.

A controllable thermal link (not shown) may also connect the first cooling element, or an additional cooling element, to components of the system that are desired to be initially at a low temperature, such as the reservoir 18. In an example, a gas gap heat switch is used as the controllable thermal link, but other controllable thermal links could be substituted. The controllable thermal link is used to pre-cool components of the system before they are further cooled by helium evaporation. The second cooling element and/or helium evaporation, especially helium-3 evaporation, then cools the components below the temperature obtained by the first cooling element or additional cooling element, so the controllable thermal link can then be disconnected to avoid unnecessary heat flow into the cold components of the system.

Once cooled by the first cooling element, the helium-3/helium-4 mixture is sent towards the reservoir 18 through the return line 36, where it undergoes cooling by the second cooling element 16. The second cooling element may be a flow restriction causing the helium to undergo Joule-Thomson (JT) expansion. The flow restriction may have an impedance for example in the range of $10^9$ to $10^{13}$ $cm^{-3}$, or in the range of $10^{10}$ to $10^{12}$ $cm^{-3}$. In one example, an impedance of $10^{11}$ $cm^{-3}$ is used. This expansion can be aided by a compressor (not shown) that increases the pressure in the return line 36, but is not strictly necessary. We find in practice that this compressor can be skipped, reducing the complexity of such a system. The primary reason for being able to skip the compressor and only use the outlet pressure of a mechanical pumping system is that one can operate with a low concentration of helium-3 in helium-4. With its higher liquefaction temperature, the helium-4 in the mixture condenses sooner and accelerates the Joule-Thomson expansion process, which is significantly more powerful when the system is cold enough for condensation. In an embodiment, the first cooling element may provide enough cooling to at least partially liquefy the helium. Thus, the one or more cooling elements need not be configured to provide sufficient cooling to generate liquid helium-3 when supplied with pure gaseous helium-3. Similarly, the relative ease of liquefying a helium mixture over pure helium-3 may enable different embodiments of the one or more cooling elements to liquefy the mixture without being configured to liquefy pure helium-3, even if JT expansion is not used. In the example embodiment shown in FIG. 1 even without a compressor, the cold elements of the system 18 including elements contained within or thermally linked to the reservoir cool below the temperature of the precooling stage of the PT or GM cooler (or technically even a 1 K pot in a wet version, or really any other way of precooling) and the controllable thermal link, if present, is opened.

Regardless of the arrangement of the one or more cooling elements, the cryogenic refrigerator 10 has a reservoir 18 arranged to receive the liquid helium 20 from the one or more cooling elements. The reservoir 18 may in an embodiment be essentially identical to the "still" of a dilution refrigerator, that accumulates liquid helium 20 after JT expansion. Within the reservoir 18 the liquid helium 20 has a surface 34 from which the liquid helium 20 may evaporate to form gaseous helium 30. The gaseous helium 30 is pumped via outlet line 22 by pump 24 to encourage further evaporation. The liquid helium 20 and thus the walls of the reservoir 18 then cool by evaporative cooling of the liquid 20, which may in turn cool a heat sink (not shown) for which the cooling is desired. This provides additional cooling beyond the cooling provided by the one or more cooling elements, for example the JT expansion. In practice, this is similar to the continuous helium-3 and helium-4 systems described above, but with the difference being what happens when the temperature is lowered further, as well as the benefits of the helium-3 and helium-4 mixture described above.

Figure 2:
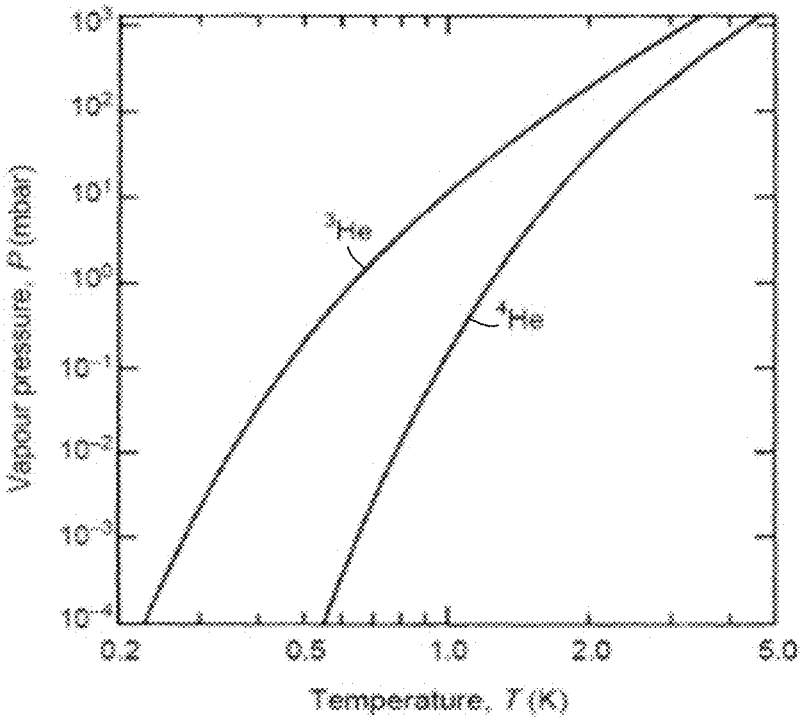
Fig. 2 (prior art)
FIG. 2 (prior art) is a diagram showing a graph of vapor pressures of helium-3 and helium-4 as a function of temperature.
Figure 3:
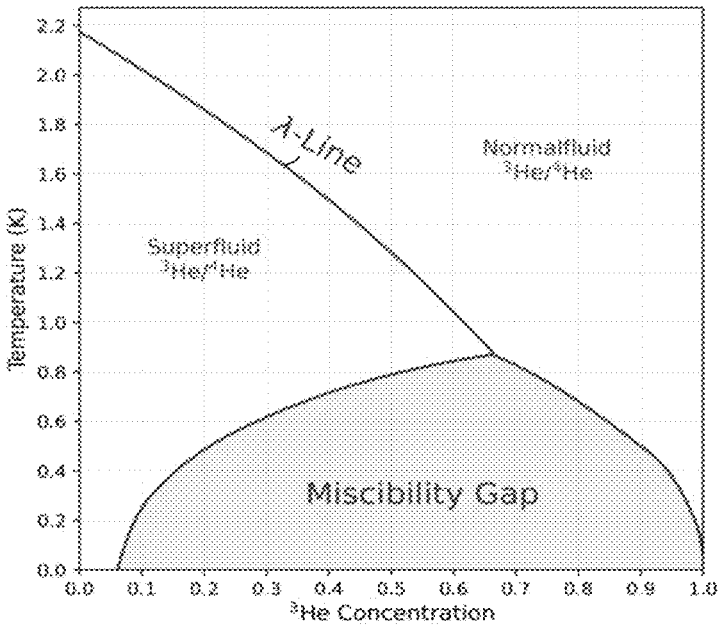
Fig. 3 (prior art)
FIG. 3 (prior art) is a phase diagram showing phases of helium-3 mixtures as a function of overall helium-3 concentration and temperature.

As evaporated helium-4 and helium-3 are pumped from the reservoir 18, the liquid helium 20 will reach a temperature at which phase separation occurs, depending on the initial concentration of helium-3 in helium-4 used. Once this phase separation occurs, the "concentrated" side 28—that is the helium-3-rich side of the phase separation—will float on top of the "dilute", or helium-4-rich, side 26 due to gravity and the smaller density of helium-3. This is the key to operation of this system at lower temperatures than would be possible without phase separation. The evaporative cooling at the reservoir occurs primarily from the floating helium-3 rich phase 28. The higher vapor pressure of the helium-3, illustrated in FIG. 2, allows this system to operate as a helium-3 refrigerator, with comparable base temperatures and cooling powers, but with a much smaller amount of helium-3. (Note the finite solubility of helium-4 in the helium-3 will slightly raise the temperature of operation based on evaporation of helium-4 instead of helium-3).

For continuous operation, the one or more cooling elements may be connected to receive gas 40 from an outlet 38 of the pump 24. The gas 40 exiting the pump 24 may thus be a flow of the same gas as the gas 30 from the reservoir 18 and pumped out by the pump 24, but brought to a higher pressure. The higher pressure may be anything above the saturated vapor pressure of helium at the temperature of the condensing element, for example in one embodiment the higher pressure may be in the range of 0.2 bar and 2.7 bar absolute pressure, while higher pressures are commonly used in prior art systems dealing with helium and would also be usable. The pump may be one or more pumps. The pump may be, for example, a simple pump or a compound pump. If multiple pumps are used, they may operate in parallel for more volume flow and/or in series for additional pressure change. A pump in series with another pump and providing additional pressure increase may be referred to as a compressor.

As remarked on above, in some embodiments the one or more cooling elements may fully liquefy the helium they cool. In embodiments with continuous operation, this may be the case in steady state operation even if not the case at initial startup. The level of liquid in the reservoir (shown in FIG. 1 by surface 34) at different times during the startup may also be higher or lower than in steady state operation. Initially, all helium in the system may be in the gas phase. As it is cooled by the one or more cooling elements, some helium is liquefied and the liquid level rises. The liquid level may drop as evaporated helium is pumped from the reservoir. The one or more cooling elements, for example the second cooling element 16 in an embodiment with a second cooling element, may be connected to a tube 42 carrying the helium cooled by the second cooling element, the tube having an exit 44 in the reservoir. The exit 44 may be at any level, for example, within the gas 30 above the surface 34, within the helium-3 rich layer 28, or within the dilute layer 26. In embodiments where the exit 44 is below the surface 34 in continuous operation, it may be desirable that the one or more cooling elements, for example the second cooling element 16, liquefy all the helium that they receive in operation, in order to avoid forming bubbles within the liquid helium. In an embodiment, the evaporative cooling of helium and heat exchange between incoming and outgoing flows may provide sufficient cooling in combination with the one or more cooling elements to provide such full liquefaction, even if the one or more cooling elements would not provide sufficient cooling, either at all regardless of flow rate or at a flow rate of helium provided in operation. This cooling enabling full liquefaction including of the helium-3 in the gas may, in an embodiment, first occur during startup using evaporation of a liquid that initially has a larger proportion of helium-4 if previous cooling was insufficient to liquefy all of the incoming helium-3.

Figure 4:
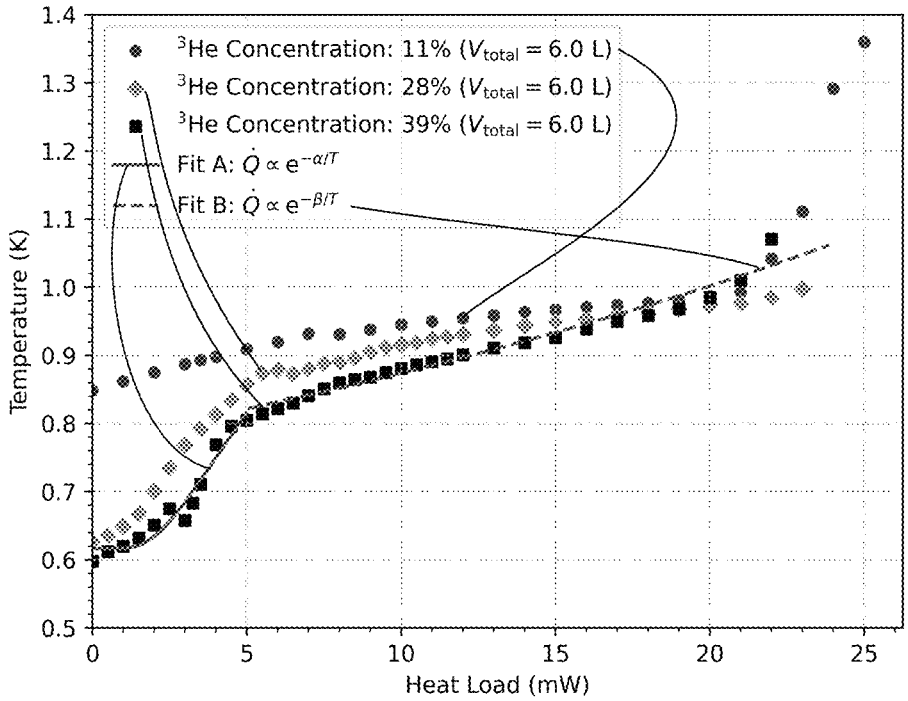
FIG. 4 is a diagram showing a graph of temperatures reached by an example system illustrated in FIG. 1 for different initial helium-3 concentrations and heat loads.

FIG. 4 shows a graph of temperature reached vs heat load for different initial helium-3 concentrations in tests of an embodiment of this system. The lowest line of dots are data obtained using an initial (room temperature) gas volume concentration of 39% helium-3 in helium-4 (with a total volume of 6.0 liters at NTP (normal temperature and pressure) used, i.e., only 2.34 liters of helium-3). The system achieved a base temperature of 585 mK, limited in part by the heat load from the returning helium-3 and in part by limitations in the pumping impedance. In practice, more efficient heat exchangers at this stage will allow for lower base temperatures. As heat was applied to the reservoir, the temperature remained below 0.7 K until an applied heat above 3 mW was reached. At this point, the helium-3 has mostly been evaporated to balance the applied heat load and there does not remain a film 28 of concentrated helium-3 floating on the dilute helium-4 side 26. Above approximately 5 mW applied heat, the rate of temperature rise changes as more heat is applied and the system operates essentially as a continuous helium-4 system, until the helium-4 is entirely depleted from the reservoir at an applied heat of 21 mW. Eventually, once there is no liquid 20 in the reservoir, such that all liquid exiting from the cooling elements to the reservoir quickly evaporates, the only cooling power in the system is provided by the JT expansion of the returning helium-3/helium-4. Data is also shown for 28% helium-3 concentration (middle line, though this becomes the lowest line above about 19 mW of heat load) and for 11% helium-3 (upper line).

Efficient heat exchange between the incoming helium-3/helium-4 and the outgoing helium-3/helium-4 helps to achieve the lowest temperature possible. Thus, the cryogenic refrigerator 10 may comprise a heat exchanger 14 arranged to exchange heat between helium going from the pump to the reservoir and helium going from the reservoir to the pump. The heat exchanger may be formed, for example, by coiling the return line 36 within the gas evaporation line 22. In a tested embodiment, the one or more cooling elements are configured to provide sufficient cooling to liquefy sufficient helium-3 to enable the phase separation (after the further cooling by pumping of the evaporated gas 30) into separate helium-3 rich and dilute phases. In an alternative embodiment, the one or more cooling elements may not provide sufficient cooling to include sufficient liquefied helium-3 on their own, but additional cooling provided by the outgoing flow of helium going from the reservoir to the pump to the incoming flow of helium going from the pump to the reservoir then provides sufficient cooling to produce liquid helium containing sufficient helium-3 to enable the formation of the separate helium-3 rich and dilute phases in continuous operation. Even in embodiments where the one or more cooling elements would eventually provide sufficient cooling, the pumping and heat exchange may enable cooling due to helium-4 evaporation before the one or more cooling elements have provided sufficient liquid helium-3 for phase separation, enabling a faster startup than if only helium-3 was used. In embodiments where there is a first cooling element 12, for example a pulse tube cooler, and a second cooling element 16, for example a flow restriction causing Joule-Thomson expansion, the heat exchanger 14 may be arranged to at least in part exchange heat between the outgoing helium flow and a portion of the incoming helium flow going from the first cooling element to the second cooling element, as shown in FIG. 1. The initial liquefied helium-4 causes cooling via evaporation, enabling the heat exchange described above, and may also help bootstrap the Joule-Thomson expansion process, as further described above.

Additionally, to ensure that primarily helium-3 instead of helium-4 is pumped from the system, similar procedures to those used in a dilution refrigerator can be used, such as a "film burner," knife-edge, or an orifice, shown in FIG. 1 in an example as helium-4 flow restriction element 32. We note, however, that these will be less useful in this system than in a dilution refrigerator, because the reservoir will generally be operated at a lower temperature than the still of a dilution refrigerator where the still temperature is raised by use of a heater to promote the enhanced circulation of helium-3. Here instead, by pumping as powerfully as possible on the reservoir, one will achieve the lowest temperatures possible. Thus, use of an orifice is likely to be counterproductive. It is also important to note that in order to pump as efficiently on the reservoir as possible, the pumping line should be designed in such a way as to not limit the pumping speed by having too large of an impedance—both at low temperatures and at room temperature. Moreover, pumps efficient at pumping helium—both mechanical, such as scroll or roots pumps, and booster pumps, such as turbo pumps—should be used. Although an orifice may be counterproductive, other means to prevent superfluid helium-4 from climbing away from liquid surface 34 may be used to reduce helium-4 evaporation. While helium-4 flow restriction element 32 is shown at a gas evaporation line 22 in FIG. 1, it might be located in other embodiments closer to the liquid surface 34 to further reduce helium-4 evaporation.

Finally, we comment on the amount of helium-3 used in this system. Adding additional helium-3 to the pumping circuit does not significantly affect the base temperature, as when operating in the phase separation regime it is already concentrated helium-3 being pumped from the reservoir. Therefore, if low cooling powers are needed, it is advisable to use the minimum concentration of helium-3 in helium-4 to achieve phase separation at the temperatures achievable by pumping on the mixture, practically we find that 25-30% volume concentration of helium-3 in the initial gas is nearly ideal. But, if one wants to have higher cooling powers at the lowest temperatures, additional helium-3 can be added to the system. This puts a larger volume of floating concentrated helium-3 in the reservoir, which can be pumped from the reservoir to balance the incoming heat load from an experiment. There is no conceptual maximum to this concentration, with 100% being the limit of a continuous helium-3 refrigerator, but the smallest suitable concentration comes with the lowest overall cost of the system. Lower helium-3 concentration also makes it easier to liquefy the mixture as described above, though also increasing the cooling requirements to obtain phase separation. It is also possible to retrofit existing cryogenic systems to operate in the phase separation mode described here. Both existing dilution refrigerators and existing helium-3 or helium-4 cryostats could be modified to take advantage of the properties described in the claims above. For a dilution refrigerator, modification could include removing the heat exchangers below the still, along with the mixing chamber, and connecting incoming liquid helium to the still, thus effectively turning the still into the helium reservoir described above. For a pumped helium-3 or helium-4 cryostat modification could be as simple as adding helium-4 or helium-3, respectively, to the gas being circulated.

In conclusion, we have invented a new type of refrigerator that lies between a continuous helium system and a dilution refrigerator. It has similar base temperature and cooling power as a helium-3 refrigerator, but can be continuous, can easily be made dry, and takes advantage of the phase separation of helium-3 and helium-4 to provide a concentrated helium-3 surface for pumping, while minimizing the complexity of the pumping system and minimizing the amount of helium-3 needed. The final point is particularly important given the limited availability and high price of helium-3. We expect this system to find wide adoption in the field of quantum technologies, where the reduced complexity and price, while enhancing the ease of use, over a dilution refrigerator will make this an attractive alternative. Especially as qubit frequencies are raised and hence can be operated at elevated temperatures, exactly into the operating range of this system.

In the claims, the word "comprising" is used in its inclusive sense and does not exclude other elements being present. The indefinite articles "a" and "an" before a claim feature do not exclude more than one of the features being present. Each one of the individual features described here may be used in one or more embodiments and is not, by virtue only of being described here, to be construed as essential to all embodiments as defined by the claims.

The invention claimed is:

1. A cryogenic refrigerator comprising:

one or more cooling elements arranged to at least partially liquefy helium from a gas containing a mixture of helium-3 and helium-4 to produce liquid helium having a sufficient concentration of helium-3 to enable the separation of the helium-3 and helium-4 when further cooled into separate helium-3 rich and dilute phases;

a reservoir arranged to receive an incoming flow of helium including the liquid helium produced by the one or more cooling elements to form a volume of the liquid helium in the reservoir, and to expose a surface of the volume of the liquid helium to evaporation to cool the reservoir under evaporation of the liquid helium; and one or more pumps connected to the reservoir to remove evaporated gaseous helium from a space above the surface to form an outgoing flow of helium from the reservoir to the one or more pumps, and the one or more cooling elements being connected to an outlet of the one or more pumps to receive the helium of the outgoing flow of helium for continuous operation of the cryogenic refrigerator, the one or more pumps being arranged to sufficiently lower a pressure in the space above the surface of the liquid helium to cool the liquid helium to cause the liquid helium in the reservoir to separate into the separate helium-3 rich and dilute phases, where the helium-3 rich phase is adjacent to the surface for further evaporation into the space above the surface and further cooling as the one or more pumps in operation continue to remove evaporated helium-3 above the surface after phase separation.

2. The cryogenic refrigerator of claim 1 further comprising a heat exchanger arranged to exchange heat between the incoming flow of helium and the outgoing flow of helium.

3. The cryogenic refrigerator of claim 2 in which the one or more cooling elements are configured to provide sufficient cooling, before evaporation of the liquid helium, to liquefy at least some helium-4, but the one or more cooling elements are not configured to provide sufficient cooling before evaporation of the liquid helium to liquefy sufficient helium-3 to enable the phase separation into separate helium-3 rich and dilute phases under further cooling of the liquid helium in the reservoir; and wherein the one or more cooling elements and the heat exchanger are configured to collectively provide, when the one or more pumps remove evaporated helium-3 to generate the outgoing flow of helium, sufficient cooling to the incoming flow of helium to liquefy sufficient helium-3 to enable the formation of the separate helium-3 rich and dilute phases under further cooling of the liquid helium in the reservoir.

4. The cryogenic refrigerator of claim 1 in which the one or more cooling elements comprise a first cooling element and a second cooling element arranged to receive helium from the first cooling element.

5. The cryogenic refrigerator of claim 4 further comprising a heat exchanger arranged to exchange heat between the incoming flow of helium and the outgoing flow of helium and in which the heat exchanger is arranged to at least in part exchange heat between the outgoing flow of helium and a portion of the incoming flow of helium going from the first cooling element to the second cooling element.

6. The cryogenic refrigerator of claim 4 in which the second cooling element is a flow restriction causing Joule-Thomson expansion.

7. The cryogenic refrigerator of claim 4 in which the first cooling element is a pulse tube cooler.

8. The cryogenic refrigerator of claim 4 in which the first cooling element is a Gifford-McMahon cooler.

9. The cryogenic refrigerator of claim 4 in which the first cooling element comprises a vessel of liquid helium.

10. The cryogenic refrigerator of claim 4 in which the first cooling element at least partially liquefies the incoming flow of helium.

11. The cryogenic refrigerator of claim 1 in which the one or more cooling elements fully liquefy the incoming flow of helium.

12. A method of cryogenic refrigeration, the method comprising the steps of:

cooling a helium gas comprising a mixture of helium-3 and helium-4 using one or more cooling elements to provide liquid helium containing helium-3 and helium-4 with a sufficient concentration of helium-3 to enable separation into helium-3 rich and helium-3 dilute phases;

receiving an incoming flow of helium including the liquid helium produced by the one or more cooling elements in a reservoir to form a volume of the liquid helium in the reservoir, the volume of the liquid helium in the reservoir having a surface exposed to evaporation;

providing one or more pumps connected to the reservoir to remove helium gas from a space above the surface;

operating the one or more pumps to form an outgoing flow of helium from the reservoir to the one or more pumps and to cause the liquid helium within the reservoir to cool sufficiently by evaporation to cause a phase separation of the liquid helium into separate helium-3 rich and dilute phases, where the helium-3 rich phase is adjacent to the surface for further evaporation into the space above the surface; and continuing to operate the one or more pumps after separation into helium-3 rich and dilute phases to remove helium-3 rich gas above the surface evaporated from the helium-3 rich phase and further cool the reservoir, the one or more cooling elements receiving, from an outlet of the one or more pumps, the helium from the outgoing flow of helium for continuous operation of the cryogenic refrigerator.

13. The method of claim 12, further comprising the step of exchanging heat between the incoming flow of helium and the outgoing flow of helium.

14. The method of claim 13 further comprising the steps of, before the step of providing the reservoir comprising a mixture of helium-3 and helium-4 in the sufficient ratio:

providing the reservoir with liquid helium having too little helium-3 to enable the phase separation;

operating the one or more pumps to cause the liquid helium to cool and to form the outgoing flow of helium; and exchanging heat between the incoming flow of helium and the outgoing flow of helium to enable the cooling elements to generate liquid helium having sufficient helium-3 to enable the phase transition.

15. The method of claim 12 in which the step of cooling the helium comprises the steps of:

providing initial cooling to the helium at a first cooling element of the one or more cooling elements;

receiving the helium cooled by the first cooling element at a second cooling element of the one or more cooling elements; and providing further cooling to the helium at the second cooling element.

16. The method of claim 15 further comprising the step of exchanging heat between the incoming flow of helium and the outgoing flow of helium, the step of exchanging heat between the incoming flow of helium and the outgoing flow of helium comprising at least in part exchanging heat between the outgoing flow of helium and a portion of the incoming flow of helium going from the first cooling element to the second cooling element.

17. The method of claim 15 in which the second cooling element is a flow restriction causing Joule-Thomson expansion.

18. The method of claim 15 in which the first cooling element is a pulse tube cooler.

19. The method of claim 15 in which the first cooling element is a Gifford-McMahon cooler.

20. The method of claim 15 in which the first cooling element comprises a vessel of liquid helium.

21. The method of claim 15 in which the first cooling element at least partially liquefies the incoming flow of helium.

22. The method of claim 12 in which the one or more cooling elements fully liquefy the incoming flow of helium.

23. An apparatus configured to carry out the steps of claim 14, the apparatus comprising:

the one or more cooling elements, the reservoir, the reservoir being configured to receive the incoming flow of helium including the liquid helium produced by the one or more cooling elements in a reservoir to form the volume of the liquid helium in the reservoir, the volume of the liquid helium in the reservoir having the surface exposed to evaporation;

the one or more pumps, the one or more pumps being configured to carry out the steps of:

operating the one or more pumps to cause the liquid helium to cool and to form the outgoing flow of helium;

operating the one or more pumps to cause the liquid helium within the reservoir to cool sufficiently by evaporation to cause a phase separation of the liquid helium into separate helium-3 rich and dilute phases, where the helium-3 rich phase is adjacent to the surface for further evaporation into the space above the surface; and continuing to operate the one or more pumps after separation into helium-3 rich and dilute phases to remove helium-3 rich gas above the surface evaporated from the helium-3 rich phase and further cool the reservoir, the one or more cooling elements receiving, from an outlet of the one or more pumps, the helium from the outgoing flow of helium from for continuous operation of the cryogenic refrigerator; and a heat exchanger configured to carry out the step of exchanging heat between the incoming flow of helium and the outgoing flow of helium;

in which the one or more cooling elements are configured to provide sufficient cooling to liquefy at least some helium-4 before the step of operating the one or more pumps to cause the liquid helium to cool, but the one or more cooling elements are not configured to provide sufficient cooling before the step of operating the one or more pumps to cause the liquid helium to cool to liquefy sufficient helium-3 to enable the phase separation into separate helium-3 rich and dilute phases under further cooling of the liquid helium in the reservoir, and in which the one or more cooling elements and the heat exchanger are configured to collectively provide, when the one or more pumps remove evaporated helium-3 to generate the outgoing flow of helium, sufficient cooling to the incoming flow of helium to liquefy sufficient helium-3 to enable the formation of the separate helium-3 rich and dilute phases under further cooling of the liquid helium in the reservoir and carry out the step of cooling the helium gas comprising a mixture of helium-3 and helium-4 using one or more cooling elements to provide liquid helium containing helium-3 and helium-4 with a sufficient concentration of helium-3 to enable separation into helium-3 rich and helium-3 dilute phases.

* * * * *